US009752762B1

(12) United States Patent
Poe, III

(10) Patent No.: US 9,752,762 B1
(45) Date of Patent: Sep. 5, 2017

(54) RECHARGEABLE WRIST-MOUNTED WORK LIGHT

(71) Applicant: Renzie M. Poe, III, Wamego, KS (US)

(72) Inventor: Renzie M. Poe, III, Wamego, KS (US)

( * ) Notice: Subject to any disclaimer, the term of this patent is extended or adjusted under 35 U.S.C. 154(b) by 203 days.

(21) Appl. No.: 14/623,271

(22) Filed: Feb. 16, 2015

Related U.S. Application Data

(60) Provisional application No. 62/021,962, filed on Jul. 8, 2014.

(51) Int. Cl.

| | |
|---|---|
| ***F21V 21/08*** | (2006.01) |
| ***F21V 33/00*** | (2006.01) |
| ***F21L 4/08*** | (2006.01) |
| ***F21L 4/02*** | (2006.01) |
| ***A44C 5/00*** | (2006.01) |
| *F21W 131/30* | (2006.01) |
| *F21Y 101/02* | (2006.01) |

(52) U.S. Cl.
CPC ..... *F21V 21/0832* (2013.01); *A44C 5/0007* (2013.01); *F21L 4/027* (2013.01); *F21L 4/085* (2013.01); *F21V 33/0008* (2013.01); *F21W 2131/30* (2013.01); *F21Y 2101/02* (2013.01)

(58) Field of Classification Search
CPC ..... A45F 2005/008; F21L 4/00; F21L 4/085; F21L 7/08; F21L 11/00; F21L 15/14; F21L 4/005; F21V 17/10; F21V 21/403; F21V 21/406; F21V 21/0816; F21V 21/0885; F21V 21/0832; F21Y 2103/10; A44C 5/0007; A61B 5/681; A61B 5/6824; A61B 90/30
See application file for complete search history.

(56) References Cited

U.S. PATENT DOCUMENTS 1,769,241 A * 7/1930 Stephani ..... F21L 15/14 224/221
2,642,520 A * 6/1953 Keely ..... F21L 4/085 320/111

(Continued)

FOREIGN PATENT DOCUMENTS

GB 2484780 A * 4/2012 ..... A45F 5/00

OTHER PUBLICATIONS http://www.surefire.com/illumination/wristlights.html (May 3, 2013).

*Primary Examiner* — Hargobind S Sawhney
(74) *Attorney, Agent, or Firm* — Robert C. Montgomery; Montgomery Patent and Design, LP.

(57) ABSTRACT

A work light comprised of a removable band that is configured to attach to a user's wrist and forearm. The band includes a first attachment assembly for holding a rechargeable first flashlight such that the first flashlight illuminates around a user's index finger. The first flashlight includes an internal rechargeable first battery and a first pair of external battery contacts for applying recharging energy to the first flashlight. The work light also includes a charger for applying recharging energy to the first pair of external battery contacts. The charger has a first socket for receiving the first flashlight and a first pair of charger contacts for electrically connecting to the first pair of external battery contacts. Preferably the band holds a rechargeable second flashlight so as to direct its illumination toward the little finger. Then, the charger includes a socket for charging the second flashlight.

9 Claims, 5 Drawing Sheets

(56) References Cited

U.S. PATENT DOCUMENTS

| | | | | |
|---|---|---|---|---|
| 3,112,889 | A | 12/1963 | Marmo et al. | |
| 5,165,048 | A * | 11/1992 | Keller | F21L 4/085 320/113 |
| 5,191,197 | A * | 3/1993 | Metlitsky | G06K 7/10564 235/462.44 |
| 5,329,638 | A * | 7/1994 | Hansen | A41D 13/088 2/16 |
| 5,448,458 | A | 9/1995 | Smyly, Jr. | |
| 6,062,700 | A * | 5/2000 | Price | A45F 5/00 362/103 |
| 6,082,872 | A * | 7/2000 | Ting | F21L 4/00 362/191 |
| 6,213,619 | B1 | 4/2001 | Yu | |
| 6,550,930 | B1 | 4/2003 | Portouche | |
| 7,815,334 | B2 | 10/2010 | Sherman | |
| 8,303,129 | B1 * | 11/2012 | Thielen | F21L 4/00 362/103 |
| 8,398,255 | B2 | 3/2013 | Starogiannis | |
| 9,002,317 | B2 * | 4/2015 | Hymowitz | H04W 4/22 455/404.1 |
| 2005/0184703 | A1 * | 8/2005 | Parker | H02J 7/0042 320/114 |
| 2006/0285404 | A1 * | 12/2006 | Alexander | A45F 5/00 365/200 |
| 2010/0299905 | A1 * | 12/2010 | McCoy | F41C 33/0236 29/428 |

* cited by examiner

RECHARGEABLE WRIST-MOUNTED WORK LIGHT

RELATED APPLICATIONS

This application claims the benefit of U.S. Provisional Application No. 62/021,962, which was filed Jul. 8, 2014, the entire disclosures of which are incorporated herein by reference.

FIELD OF THE INVENTION

The present invention relates generally to work lights. More particularly it is directed to a work light assembly that is worn on the wrist and forearm of a user.

BACKGROUND OF THE INVENTION

Just about everyone has had the unfortunate experience of trying to perform a complicated task with their hands while working in poor light conditions. Most times a flashlight is used to provide needed illumination. However, using a flashlight typically means that one has to balance the flashlight somehow, often under one's chin or on a nearby object to allow the use of both hand's to perform the task. Should another person be available to hold the flashlight the flashlight beam typically wanders about as the holder loses attention.

Accordingly, there exists a need for a temporary task lighting device that can illuminate the area immediately around a user's hands without the disadvantages described above. Ideally such a device would be easy to use and would not require the aid of another person. Preferably such a device would leave both hands of a user free to perform tasks while the illuminate adjusts to meet the user's needs.

SUMMARY OF THE INVENTION

The principles of the present invention provide for an improved work light assembly that illuminates the area around a user's hands. The improved work light assembly is a wrist-mounted work light device that is easy to use, leaves both hands free to perform tasks, does not require the aid of another person, and provides illumination where needed.

A work light in accord with the present invention includes a removable band that is configured to attach to a user's wrist and forearm and that includes a first attachment assembly. The work light further includes a rechargeable first flashlight that is removably mounted to the band by the first attachment assembly. The first flashlight includes an internal rechargeable first battery and a first pair of external battery contacts for applying recharging energy to the first flashlight. Also included is a charger for applying recharging energy to the first pair of external battery contacts. The charger has a first socket for receiving the first flashlight and a first pair of charger contacts for electrically connecting to the first pair of external battery contacts. The first attachment assembly mounts the first flashlight such that illumination from the first flashlight can illuminate the area around a user's hand.

Preferably the work light also includes a rechargeable second flashlight having an internal rechargeable second battery and a second pair of external battery contacts for applying recharging energy to the second flashlight. The charger may also have a second holder for receiving the second flashlight and a second pair of charger contacts for electrically connecting to the second pair of external battery contacts. The band may include a second attachment assembly for removably mounting the second flashlight. In practice the first attachment assembly should mount the first flashlight to direct illumination toward a user's index finger while the second attachment assembly mounts the second flashlight to direct illumination toward a user's little finger.

Beneficially the band has an adjustable diameter and may have a substrate, a cover over the substrate; and a padding layer disposed between the substrate and the cover. Ideally the cover is a woven fabric. The first attachment assembly may include a first strap located on the cover and which is formed into a loop. The first strap may be of an elastic material. The first flashlight can then include a recess in proximity to its front for receiving the first strap. The first attachment assembly further includes a first half fastener comprised of a first part of a hook and loop fastening pair. The first flashlight may include a second part of the hook and loop fastening pair. The band may further include a knitted nylon material with embedded elastic fibers. In practice the band further includes a tongue that is configured as a strip of material. The tongue then has a first securing fastener comprised of a section of a hook-and-loop fastener, and wherein the band further includes a mating second securing fastener.

The charger may also include a second socket for receiving said second flashlight. The charger can further include a first lamp for signaling when charging of said first flashlight is complete and a second lamp for signaling when charging of said second flashlight is complete. Those first lamps can be light-emitting diodes (LED's). The charger can receive electrical power from an AC socket.

BRIEF DESCRIPTION OF THE DRAWINGS

The advantages and features of the present invention will become better understood with reference to the following more detailed description and claims taken in conjunction with the accompanying drawings in which like elements are identified with like symbols and in which:

DESCRIPTIVE KEY

Figure 1:
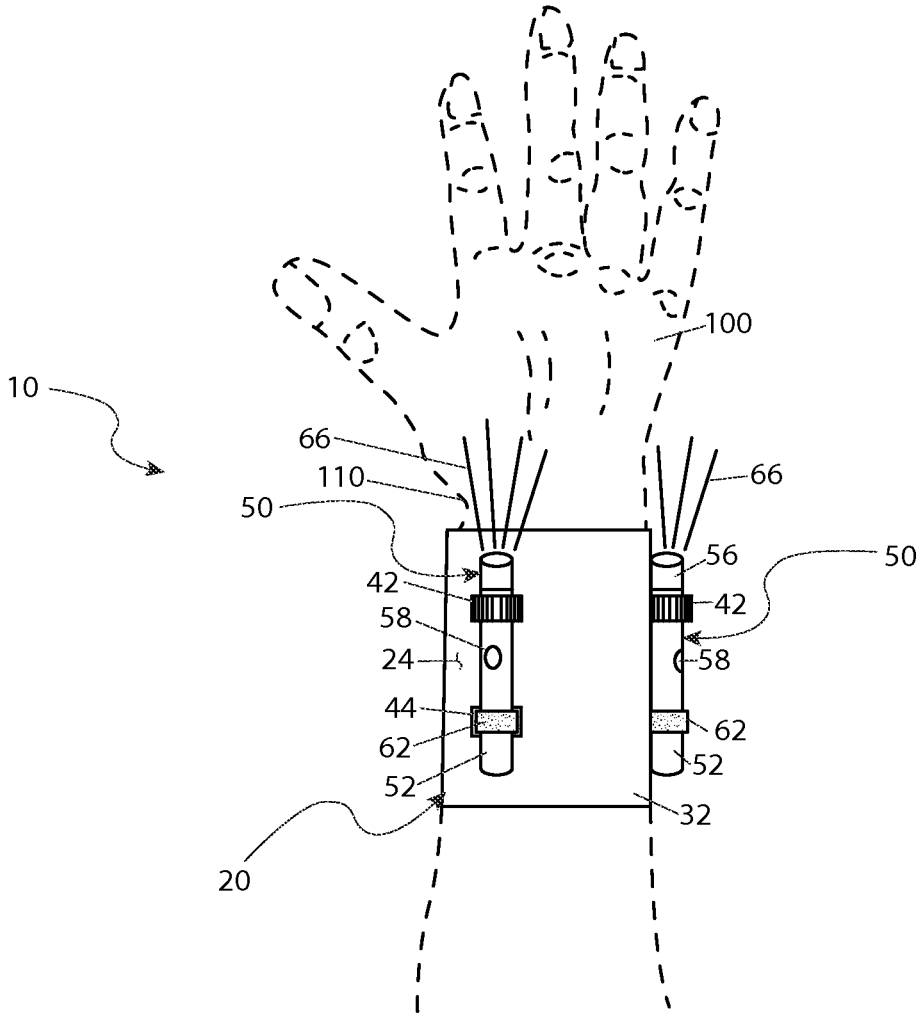
FIG. 1 is a top-down view of a wrist-mounted light 10 on a user's wrist 110 in accordance with the preferred embodiment of the present invention.

10 wrist-mounted light
20 band
22 channel
24 cover
25 padding layer
26 substrate
31 seam
32 first section
34 second section
36 tongue
38*a* first securing fastener
38*b* second securing fastener
42 strap
44 first securing half

48 flashlight contacts
50 flashlight
51 battery
52 chassis
54 relief recess
56 head
58 switch
62 second securing half
66 illumination
70 battery charger
72 cord
74 plug
76 socket
78 charger switch
80 recharger contact
82 charge light indicator
89 power supply
110 wrist
115 forearm

DETAILED DESCRIPTION OF THE PREFERRED EMBODIMENT

The preferred embodiment of the present invention is depicted within FIGS. 1 through 5. However, the invention is not limited to what is specifically illustrated and described. A person skilled in the art will appreciate that many other embodiments of the invention are possible without deviating from the basic concept of the invention. Any such work around also falls with the scope of this invention.

The terms "a" and "an" herein do not denote a limitation of quantity, but rather denote the presence of at least one (1) of the referenced items. In addition, unless otherwise denoted all directional signals such as up, down, left, right, inside, outside are taken relative to the illustration shown in FIG. 1.

Figure 2:
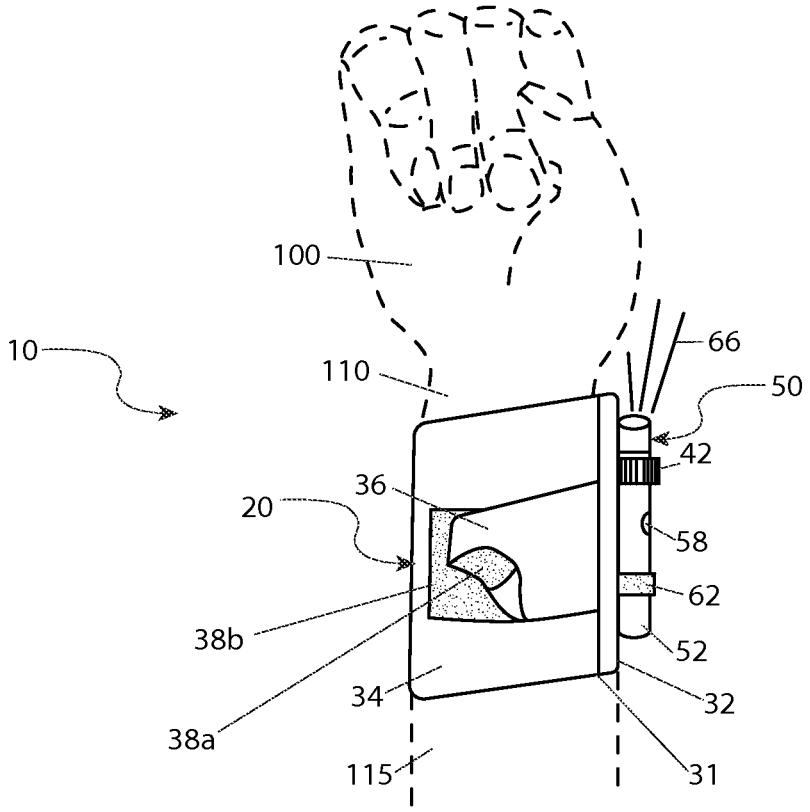
FIG. 2 is a planar view of the wrist-mounted light 10 shown in FIG. 1.

Refer now respectively to FIGS. 1 and 2 for a top down and a planar view of a rechargeable wrist-mounted work light 10 that is in accord with the present invention and which is worn on a user's wrist 110 and forearm 115. The wrist-mounted work light 10 provides at least one (1), but preferably 2, removable and rechargeable flashlight 50 attached to a band 20. The band 20 is worn around the wrist 110 and forearm 115 of a user in such a way as to direct illumination 66 into the area in the vicinity of the user's hand 100. The wrist-mounted work light 10 preferably has two (2) flashlights 50 to increase the light pattern over a larger field of view. The flashlights 50 are arranged in such a way that shadows are reduced by the light coming from different directions.

Figure 4:
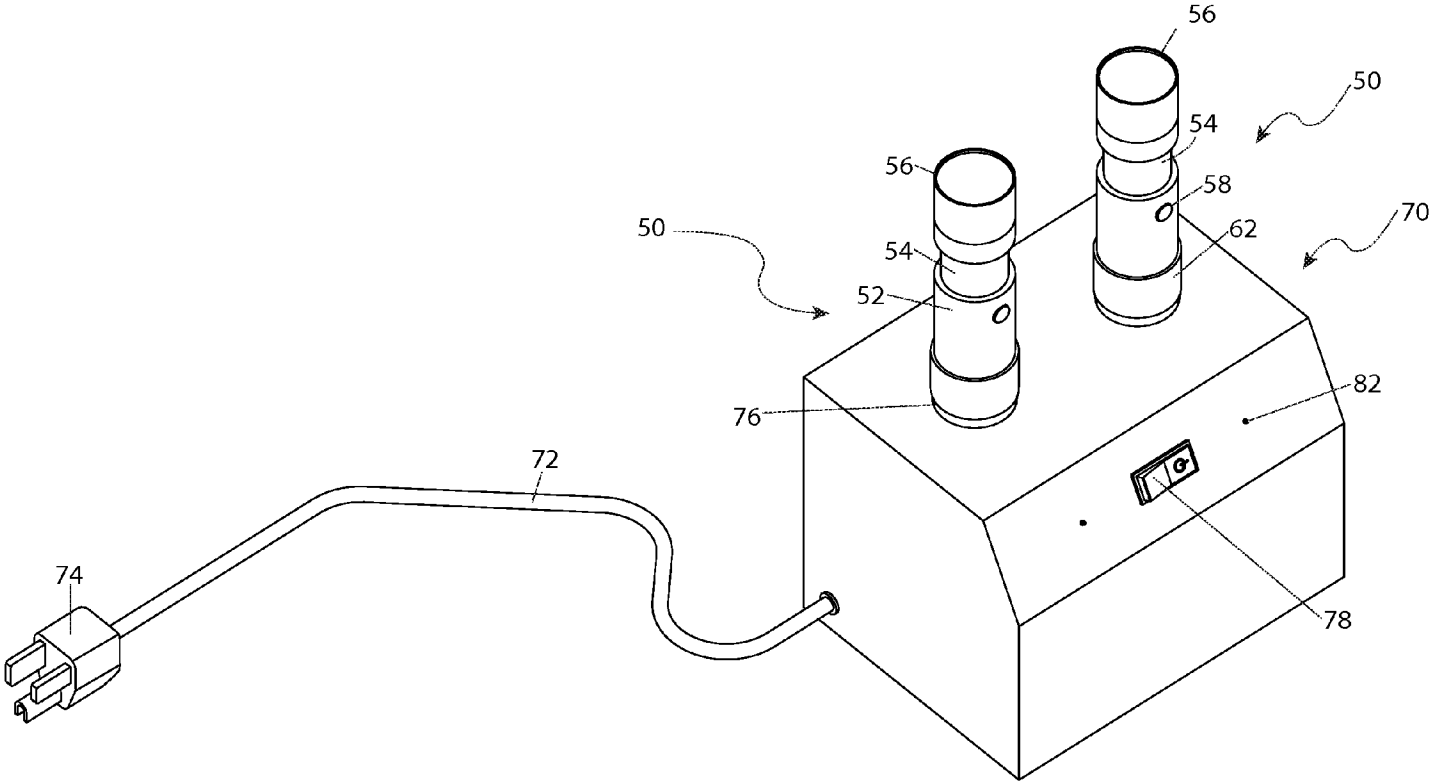
FIG. 4 is a view of a battery charger 70 with flashlights 50 of the wrist-mounted light 10 shown in FIG. 1; and, FIG. 5 presents an electrical schematic of the battery charger 70 with flashlights 50 shown in FIG. 4.

Turning now to FIG. 4, the wrist-mounted work light 10 includes a battery charger 70 that recharges the flashlights 50 from a standard 110-VAC power supply. The construction of the battery charger 70 and the flashlights 50 are such that the batteries 51 (see FIG. 5) within the flashlights 50 are not removed for charging. However, they flashlights 50 are constructed such that their batteries 51 can be removed for replacement. Thus the flashlights 50 should be understood as being a one piece unit in use, including recharging.

Figure 3:
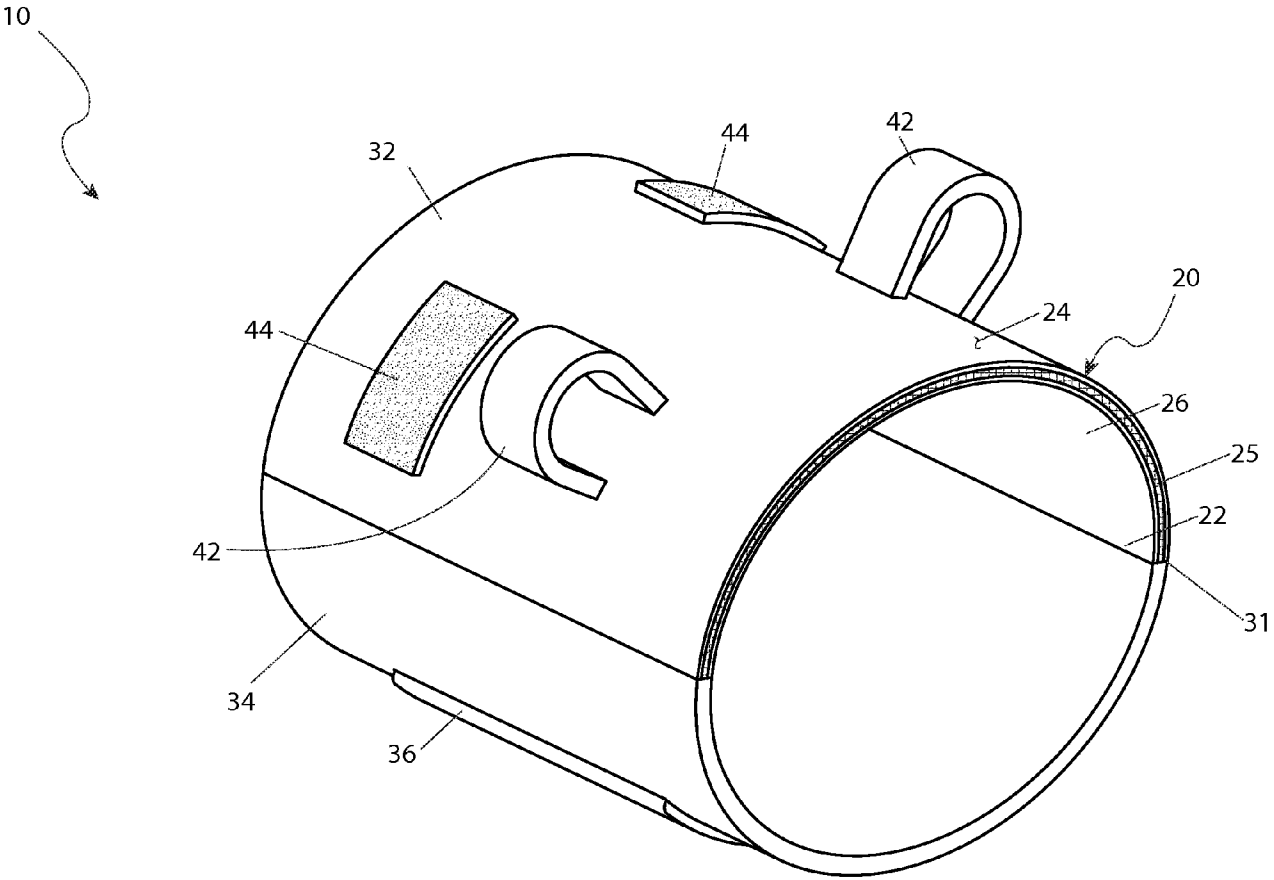
FIG. 3 is an isolated view of a band 20 of the wrist-mounted light 10 shown in FIG. 1.

Refer now to FIGS. 2 and 3, since the sizes of the wrists 110 and forearms 115 of different users can vary widely it should be understood that different size bands 20 may be made available. In any event the band 20 is adjustable and generally cylindrical. The band 20 has in an internal channel 22 to accommodate a user's forearm 115 and wrist 110.

A first section 32 of the band 20 is composed of a cover 24 over a substrate 26 that forms the internal channel 22. The cover 24 is preferably a woven nylon fabric in any of a variety of colors and/or patterns and includes a padding layer 25 that mates with the substrate 26. It is understood that other materials, such as other textiles, may be utilized without limiting the scope of the wrist-mounted work light 10. The padding layer 25 may be a foamed polymer, or a batting. The cover 24 with the padding layer 23 reduces objectionable contact between the flashlights 50 and the user. The first section 32 constitutes approximately forty-five percent (45%) of the encircling band 20.

Disposed along the cover 24 in proximity to a first (distal) end of the band 20 is at least one (1) strap 42 that is attached to the cover 24. Each strap 42 is configured as a loop made from an elastic material that is capable of securing the front end of a flashlight 50 to the band 20. The relationship of the strap and the flashlight 50 is discussed in more detail subsequently. Also disposed along the cover 24 in longitudinal alignment with the strap 42 is at least one (1) first fastener half 44. The first half fastener 44 is preferably a square section of the hook portion of a hook-and-loop fastener. The rear of the flashlight 50 is attached to the first fastener half 44 while the front of the flashlight 50 fits into the strap 42. Preferably at least one flashlight 50 is mounted such that it is in alignment with the index finger of a user's hand 100. A second flashlight 50 would be attached to the band 20 approximately ninety degrees) (90° around the circumference of the band 20.

Still referring to FIG. 3, the remainder of the band 20 is a second section 34 is composed preferably of a knitted nylon material with embedded elastic fibers that can provide the resiliency required to accommodate the insertion of the user's hand 100, wrist 110 and forearm 115 while comfortably constricting about the wrist 110 to retain the band 20 in a desired position.

The band further includes a seam 31 that delineates the transition between the first section 32 and second section 34. Disposed longitudinally along the second section 34 is a tongue 36 that is configured as a strip of material, preferably a reinforced double layer of woven nylon. A first securing fastener 38*a*, being one section of a hook-and-loop fastener is located on the inside face of the tongue 36. A mating second securing fastener 38*b* is located on the outer surface of the second section 34. After the band 20 is placed onto a user's wrist 110 the tongue 36 may be variably attached to a selected location on the second section 34 via the securing fasteners 38*a*, 38*b*. This variability enables modification of the compressive forces to improve the fit and security of the band 20.

Returning now to FIGS. 1 and 2, the flashlight 50 is preferably a small, cylindrical source of illumination 66 having an internally contained rechargeable battery (not shown). The flashlight 50 is approximately three inches (3 in.) in length and three-quarters inches (¾ in.) in diameter. The flashlight 50 has a removable head 56 containing at least one (1) bulb (not shown), a parabolic, light-focusing reflector (not shown), and a protective lens (also not shown).

Referring now to FIG. 4, the head 56 is preferably removable. To that end it includes mutually engaged threads with the body of the flashlight 50. Removal of the head 56 facilitates replacement of the rechargeable battery (not shown). The flashlight 50 is provided with a push button ON/OFF switch 58 for turning the flashlight 50 on and off. The flashlight 50 also has a relief recess 54 between the switch 58 and the head 56. The relief recess 54 accommodates the previously discussed strap 42. Disposed at the other end of the flashlight 50 is an encircling second fastener half 62. The second fastener half 62 is the loop portion of a hook-and-loop fastener. The second fastening half 62 engages with a first fastening half 44 to help secure the flashlight 50 to the band 20 with the strap 42 placed into the relief recess 54.

Referring now to FIG. 4, the battery charger 70 re-charges the flashlight 50 while it sits in a socket 76 of the battery charger 70. The battery charger 70 preferably has sockets 76 for each flashlight 50. The battery charger 70 includes a grounded, polarity-sensitive plug 74 on an electrical cord 72 and which can be inserted into a standard household 110-VAC receptacle. The battery charger 70 is equipped with a two-position, ON/OFF rocker-type charger switch 78 and a sufficient number of charge indicator lights 82 to correspond to the number of flashlights 50 being recharged. The charge indicator lights 82 are preferably light emitting diodes emit green light when the batteries have a full charge. The charge indicator lights 82 beneficially emit red light when the associated flashlight battery 50 is charging. The battery charger 70 includes the necessary electrical components, such as, but not limited to, a step-down transformer, power converter, a current limiter, and overload protection as may be necessary to safely and efficiently recharge the battery (within each flashlight 50).

Figure 5:
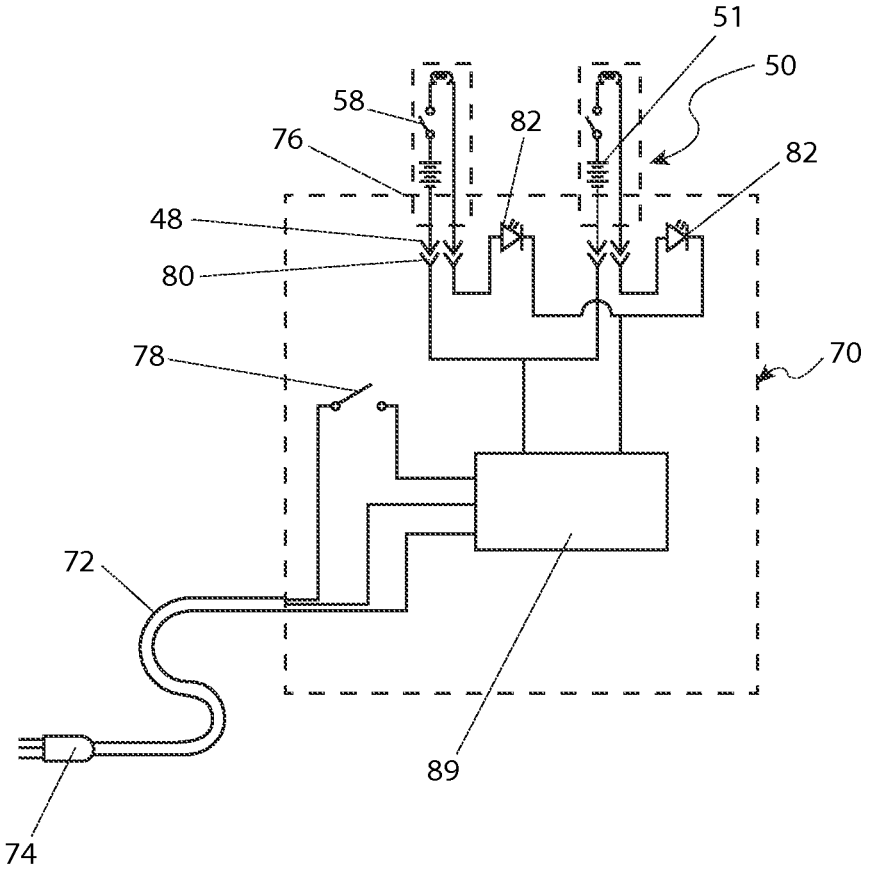

The electrical operation of the battery charger 70 is best understood with reference to FIG. 5. When the plug 74 is inserted into an AC receptacle input power is applied to the charger switch 78. When the charger switch 78 is closed electrical power is applied to a power supply 89. Battery charging current is then applied to recharger contacts 80 located in the sockets 76. When a flashlight 50 is inserted into a socket 76 the flashlight contacts 48 mate with the recharger contacts 80, thereby applying a recharging current to the battery 51. Current also flows through an associated charge indicator light 82.

The preferred embodiment of the present invention can be used by an individual in a simple and straightforward manner with little or no training. After initial purchase or acquisition of the wrist-mounted work light 10, it would be installed as indicated in FIGS. 1 and 2 on the wrist 110 of a user. Installing and using the wrist-mounted work light 10 is achieved by: acquiring a model of the wrist-mounted work light 10 having a desired size and style to suit a specific user; placing each flashlight 50 into an individual socket 76 of the battery charger 70 such that the charging contacts of the flashlight 50 are engaged into the energizing contacts of the battery charger 70; inserting the plug 74 into a standard 110-VAC receptacle; turning on the charger switch 78 to recharge the battery in each flashlight 50; inserting the head 56 of the flashlight 50 into an elasticized strap 42 so as to place the strap 42 into the relief recess 54 in the flashlight 50; securing the second fastener half 62 of the flashlight 50 to the first fastener half 44 of the band 20; repeating the attachment procedure for a second (or additional) flashlight 50; inserting the preferred hand 100 (right or left) into the channel 22 of the band 20; pulling the band 20 to a favorable location on the wrist or forearm 115 with a strap 42 and a corresponding first fastener half 44 aligned with the index finger while the remaining strap 42 and corresponding first fastener half 44 are in proximity to the little finger; altering the engagement of the tongue 36 on the securing fastener 38 so as to adjust the second section 34 to achieve a comfortable and secure fit of the band 20 on the wrist 110; turning on the selected number of flashlights 50 by manipulating the switches 58 and performing the desired work activity now having an increased level of illumination 66.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A work light, comprising:

a removable band configured to attach to a user's wrist and forearm, said removable band including a first securing fastener and a second securing fastener for securing said band to a user's wrist, a first securing half comprising the first half of a first hook and loop fastener, a first strap that forms a first outwardly extending elasticized loop; a second securing half comprising the first half of a second hook and loop fastener, and a second strap that forms a second outwardly extending elasticized loop; and, a first flashlight having a circumferential first relief recess and a second securing half comprising the second half of said first hook and loop fastener;

a second flashlight having a circumferential second relief recess and a second securing half comprising the second half of said second hook and loop fastener;

wherein said first flashlight removably attaches to said band by locating said first strap in said first relief recess and by mating said first and second halves of said first hook and loop fastener; and, wherein said second flashlight removably attaches to said band by locating said second strap in said second relief recess and by mating said first and second halves of said second hook and loop fastener.

2. The work light of claim 1, wherein said first flashlight directs illumination toward a user's index finger.

3. The work light of claim 2, wherein said second flashlight directs illumination toward a user's little finger.

4. The work light of claim 1, wherein said band has an internal cavity.

5. The work light of claim 1, wherein said band has an adjustable diameter.

6. The work light of claim 5, wherein said band comprises:

a substrate;

a cover over said substrate; and, a padding layer disposed between said substrate and said cover.

7. The work light of claim 6, wherein said cover is a woven fabric.

8. The work light of claim 6, wherein said band further includes a knitted nylon material with embedded elastic fibers.

9. The work light of claim 1, wherein said band includes a tongue having that retains said first securing fastener.

* * * * *